US006520471B2

(12) United States Patent
Jones et al.

(10) Patent No.: US 6,520,471 B2
(45) Date of Patent: Feb. 18, 2003

(54) PEDESTAL SUPPORT FOR AN ELEVATED PAVER DECK ASSEMBLY

(75) Inventors: Nigel A. S. Jones, Seattle, WA (US); Darryl Carver, Bellevue, WA (US)

(73) Assignee: Appian Construction, Inc., Seattle, WA (US)

( * ) Notice: Subject to any disclaimer, the term of this patent is extended or adjusted under 35 U.S.C. 154(b) by 0 days.

(21) Appl. No.: 09/797,650

(22) Filed: Mar. 1, 2001

(65) Prior Publication Data

US 2002/0121583 A1 Sep. 5, 2002

(51) Int. Cl.[7] ..... E04B 5/02

(52) U.S. Cl. ..... 248/346.5; 248/346.3; 52/126.6; 52/263

(58) Field of Search ..... 404/37, 43; 52/480, 52/747.1, 747.11, 747.12, 749.11, 126.6, 203, 126.5; 248/346.01, 346.03, 346.05, 346.07, 346.3, 346.5, 150, 188.8, 158; 108/150

(56) References Cited

U.S. PATENT DOCUMENTS

| | | | | | |
|---|---|---|---|---|---|
| 3,318,057 | A | * | 5/1967 | Norsworthy | 52/126.6 |
| 3,861,098 | A | * | 1/1975 | Schaub | 52/263 |
| 4,085,557 | A | * | 4/1978 | Tharp | 52/126.6 |
| 4,258,516 | A | * | 3/1981 | Mori et al. | 52/126.6 |
| 4,498,748 | A | * | 2/1985 | Jones et al. | 396/351 |
| 4,558,544 | A | * | 12/1985 | Albrecht et al. | 52/126.1 |
| 4,883,503 | A | * | 11/1989 | Fish | 52/105 |
| 4,901,490 | A | * | 2/1990 | Zinniel et al. | 248/346.5 |
| 4,996,804 | A | * | 3/1991 | Naka et al. | 52/126.1 |
| 5,363,614 | A | * | 11/1994 | Faulkner | 52/262 |
| 5,479,745 | A | * | 1/1996 | Kawai et al. | 52/126.1 |
| 6,230,460 | B1 | * | 5/2001 | Huyett | 248/560 |
| 6,363,685 | B1 | * | 4/2002 | Kuger | 52/745.05 |

FOREIGN PATENT DOCUMENTS

| | | | | |
|---|---|---|---|---|
| DE | 3913984 | * | 11/1989 | |
| JP | 406307064 A | * | 11/1994 | 52/480 |

OTHER PUBLICATIONS

Hanover Architectural Products "Year 2000 Product Reference Guide".

Hanover Architectural Products advertisement for "Paver Support Pedestal System" dated Oct. 21, 1999 (note patent number).

Envirospec, Inc. advertisement for "Pave–El" pave pedestals, no date.

Westile advertisement for plaza Paver Accessories, no date.

Sunny Brook Cast Concrete Company advertisement of pavers, no date.

Terra Paving Products' installation instructions for "Terr–Adjust" paver, no date (note patent number).

* cited by examiner

*Primary Examiner*—Ramon O. Ramirez
*Assistant Examiner*—Jon Szumny
(74) *Attorney, Agent, or Firm*—Black Lowe & Graham PLLC

(57) ABSTRACT

A pedestal support for an elevated paver deck assembly including a cylindrical tower, a cap slidably mountable on the upper end of the tower for supporting a plurality of pavers, and a base slidably mountable on the lower end of the tower. Interlocking spacers for adjusting the height of the pedestal support and the relative heights of the pavers are also provided. A method for constructing an elevated paver deck assembly including the pedestal supports is also disclosed.

13 Claims, 6 Drawing Sheets

FIG. 2
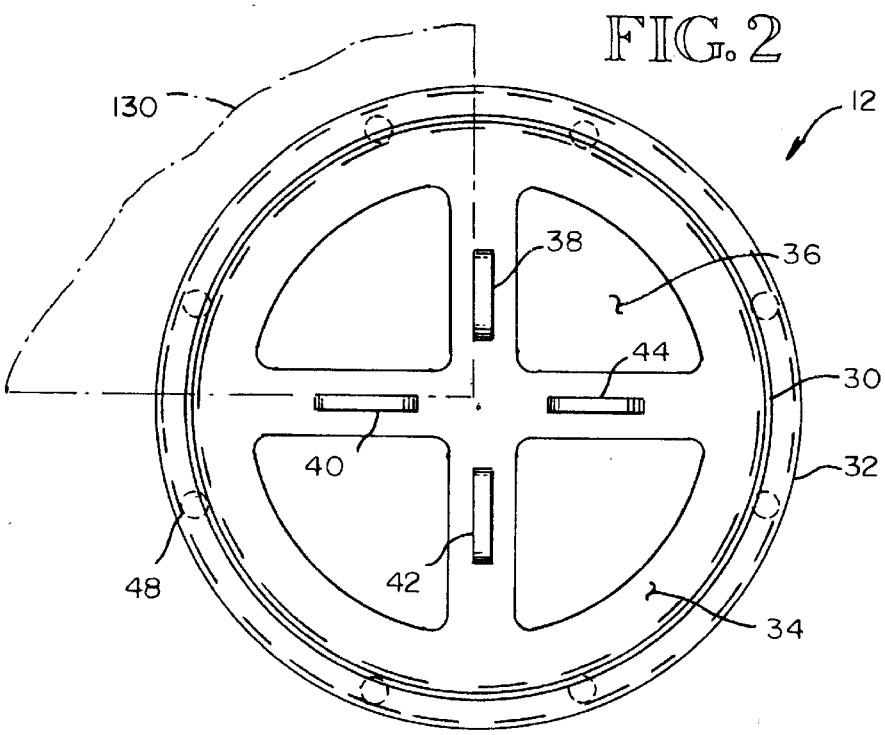
FIG. 3
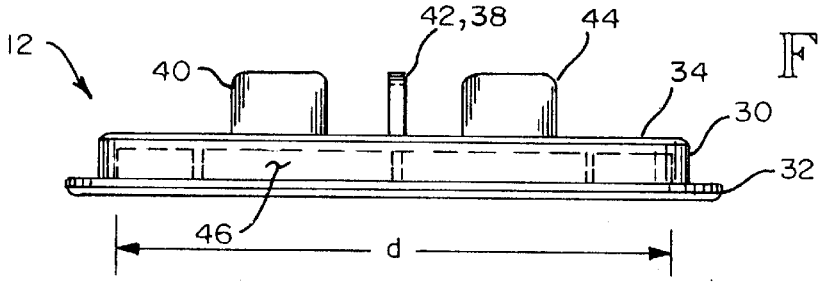
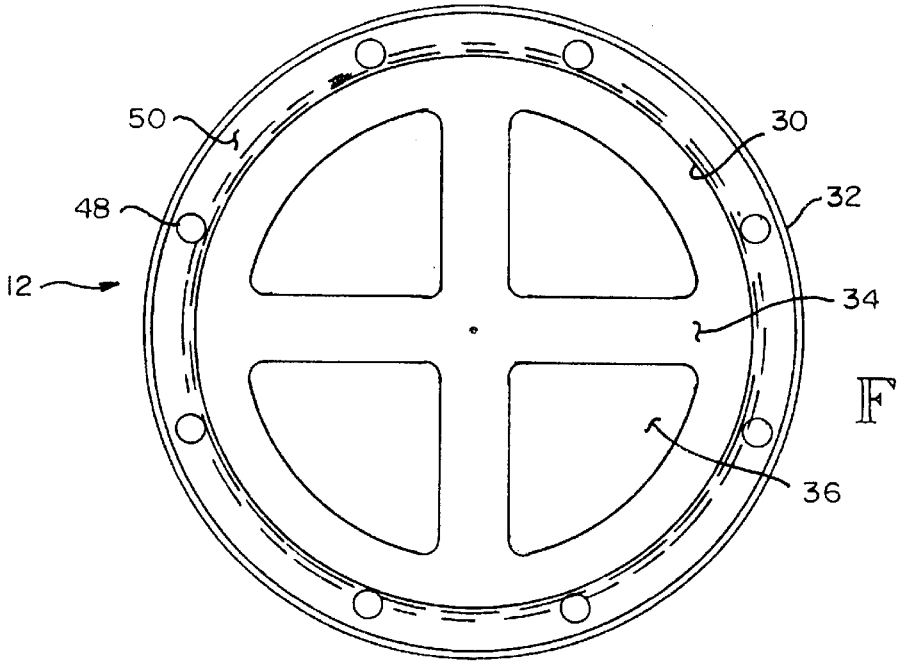
FIG. 4

FIG. 5
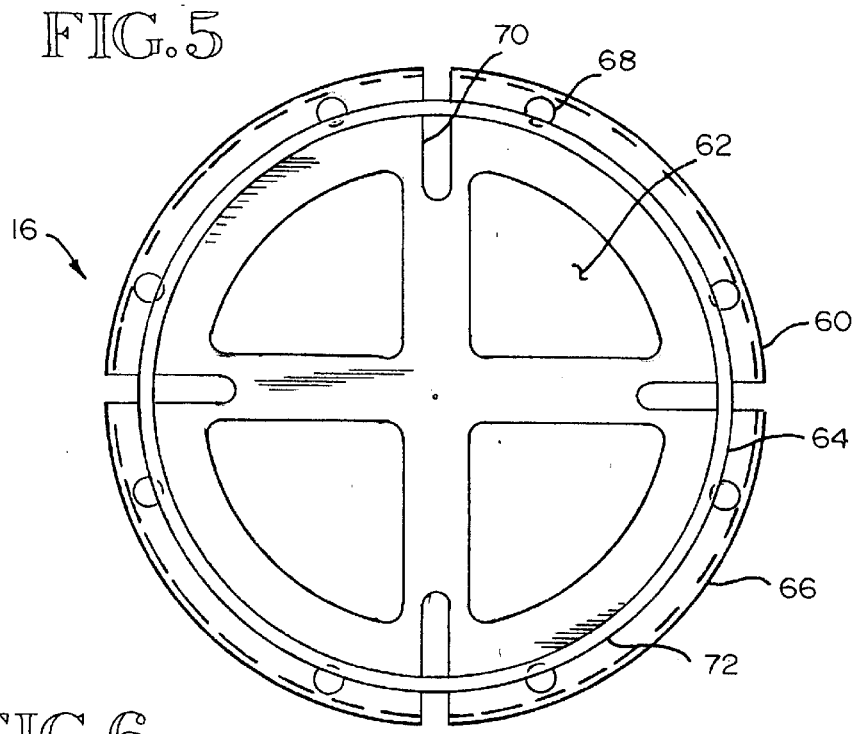
FIG. 6
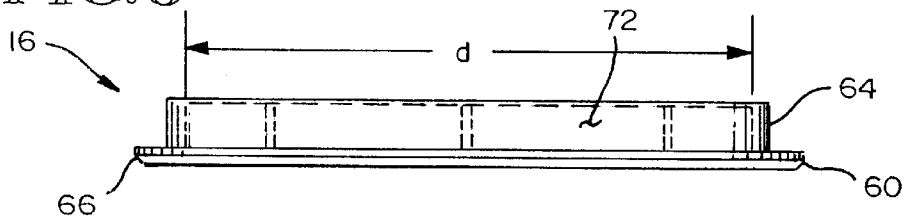
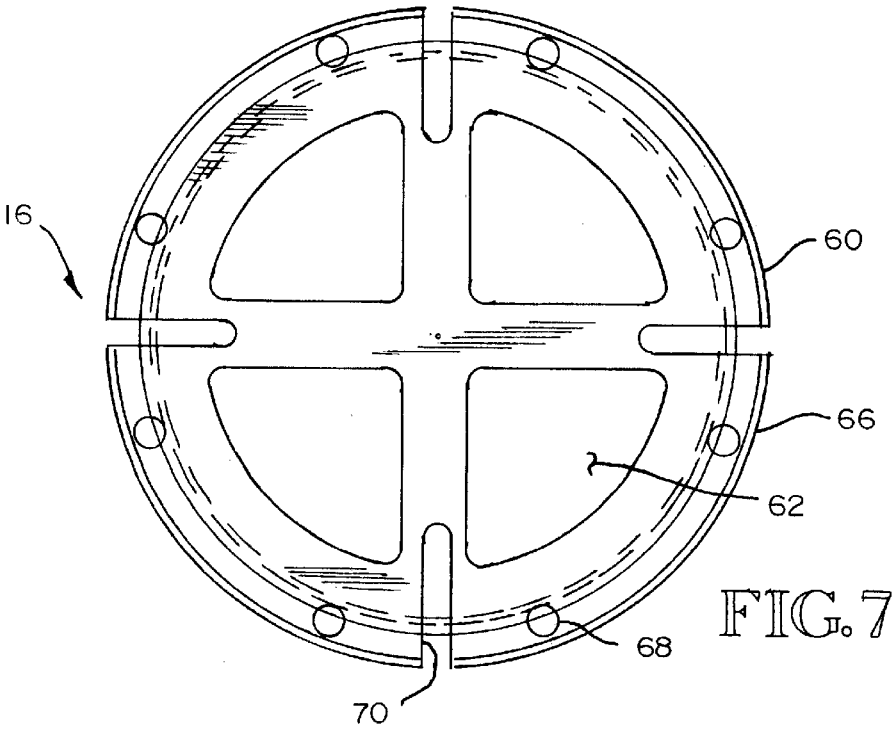
FIG. 7

FIG. 8
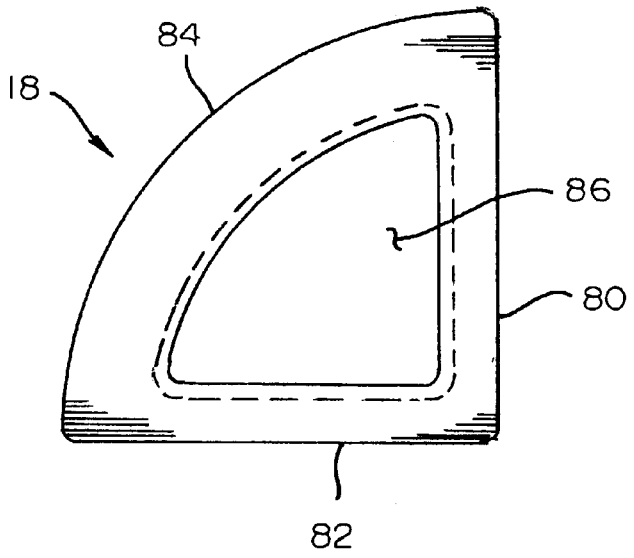
FIG. 9
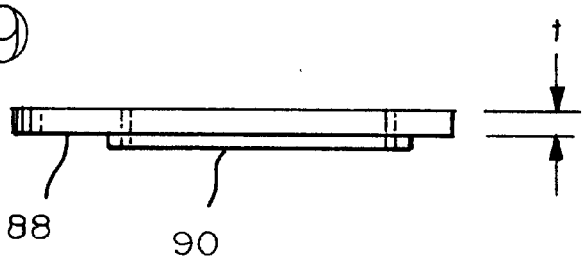
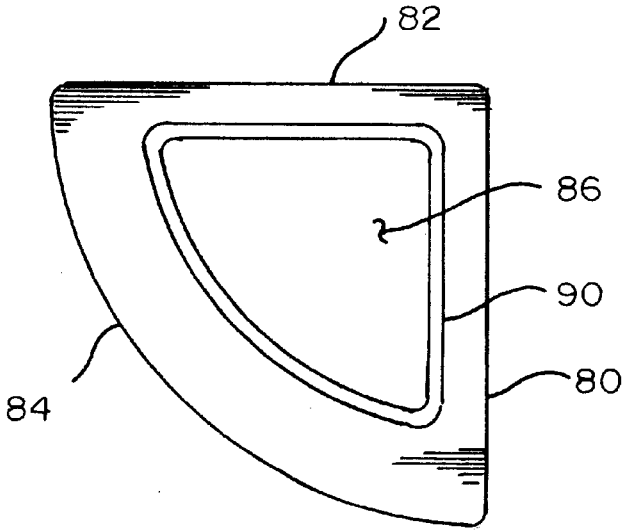
FIG. 10

PEDESTAL SUPPORT FOR AN ELEVATED PAVER DECK ASSEMBLY

TECHNICAL FIELD

This invention generally relates to decks constructed of an array of pavers and particularly to a pedestal support for an elevated paver deck assembly and a method for constructing such an assembly.

BACKGROUND OF THE INVENTION

It is well known to construct deck surfaces from an array of cut natural stone or precast concrete elements commonly referred to as "pavers". Typically, such pavers are rectangular in planform shape and are available in a variety of thicknesses. In the past such decks were usually constructed by placing the pavers on grade or in direct contact with an undersurface such as a roof. In order to facilitate drainage of the deck surface, provide for air circulation between the pavers and the undersurface and permit the construction of a level decking surface above an irregular or sloped undersurface it has become common in recent years to elevate the pavers from the undersurface. In such elevated assemblies the pavers are usually supported at their corners by a plurality of spaced pedestals or other supports resting on the undersurface.

Numerous designs for such pedestal supports are found in the prior art. One pedestal currently in use resembles a jackscrew and has a base, a cylindrical section extending upward from the base, a circular top and a cylindrical portion extending downward from the top which threadably engages the base. The height of the pedestal can be adjusted by rotating the top with respect to the base. Another known pedestal includes a vertically adjustable, hollow, cylindrical mold which is filled after adjustment with a curable proprietary mixture. When hardened the mixture forms a cylindrical core having adequate compressive strength to support the decking. The mold itself has a cylindrical base and a series of cylindrical, upwardly-extending telescopically adjustable sections.

These prior art devices function adequately as pedestals but each has certain inherent limitations and disadvantages. For example, the jackscrew unit is relatively expensive to manufacture, and as a result of its design is somewhat limited in its range of adjustability. Therefore, if a deck installation requires pedestals varying significantly in height, a number of different models of the pedestal must be kept on hand by the contractor. The pedestal having the cast core is also relatively expensive to manufacture and time-consuming to assemble. The contractor must first adjust the mold in height, then pour the core, and then await curing of the core before proceeding with assembly of the deck.

Accordingly, it is an object of this invention to provide a pedestal support for use in an elevated paver decking assembly which is relatively inexpensive to manufacture, utilizing readily available stock materials.

It is another object of this invention to provide for such a pedestal support which can be assembled rapidly on site and is usable immediately upon assembly.

It is yet another object of this invention to provide for such a pedestal support which can be sized on site over a relatively wide range of heights.

It is a further object of this invention to provide for such a pedestal which may include an interlocking pedestal shim for making minor adjustments in pedestal height and an interlocking paver shim to compensate for minor variations in paver thicknesses.

Finally, it is yet another object of this invention to provide a method for constructing an elevated paver decking assembly utilizing such a pedestal support.

SUMMARY OF THE INVENTION

This invention can be broadly summarized as providing for a pedestal support for an elevated paver deck assembly which includes a one-piece cylindrical tower formed from plastic tubing, a cap slidably mountable on the upper end of the tower for supporting a plurality of pavers, and a base slidably mountable on the lower end of the tower. According to a more detailed aspect of the invention, the cap includes a plurality of spacers for providing uniform separation between the pavers. According to yet more detailed aspects of the invention the cap includes a downwardly-extending cylindrical portion defining a recess in which the tower can be slidably inserted and the base includes an upwardly extending, cylindrical portion in which a tower can be slidably inserted.

The invention can also be summarized as providing for such a pedestal support which includes at least one shim interlockingly attachable to the bottom surface of the base to provide for minor adjustment of the pedestal height. According to another detailed aspect of the invention, the pedestal support may also include a pedestal shim interlockingly attachable to the upper surface of the cap, permitting adjustment for minor variations in pedestal thicknesses.

The invention can also be summarized as providing for a method for constructing an elevated paving deck assembly which includes an array of pavers and a plurality of pedestal supports. Each such pedestal support includes a cap, a base, and a cylindrical tower slidably mountable on the base and cap. The method includes the step of fabricating the tower to a predetermined length to provide a pedestal support of a predetermined height. According to this method, the pedestal may be fabricated by cutting it from cylindrical PVC stock material. The method may also include the step of adjusting the height of the pedestal support by placing an interlocking shim beneath the base. It may also include the further step of adjusting the relative heights of a least two pavers by placing an interlocking shim on the cap.

BRIEF DESCRIPTION OF THE DRAWINGS

FIGS. 2, 3 and 4 are top, front and bottom views, respectively, of the cap of FIG. 1.

FIGS. 5, 6 and 7 are top, front and bottom views, respectively, of the base of FIG. 1.

FIGS. 8, 9 and 10 are top, front and bottom views, respectively, of the paver shim of FIG. 1.

DETAILED DESCRIPTION OF THE PREFERRED EMBODIMENTS

The novel features believed to be characteristic of this invention are set forth in the appended claims. The invention itself, however, may be best understood and its various objects and advantages best appreciated by reference to the detailed description below in connection with the accompanying drawings.

Figure 1:
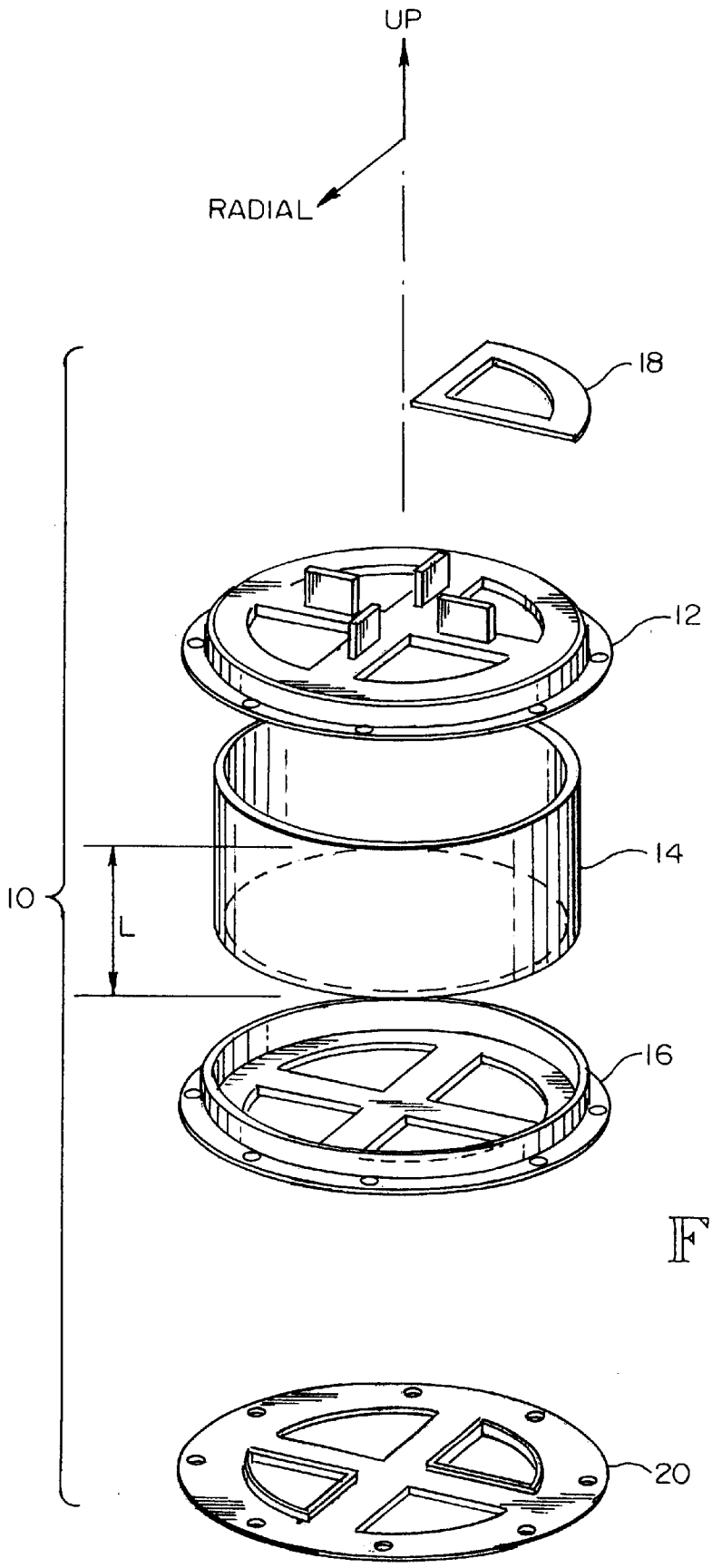
FIG. 1 is an exploded perspective view of a pedestal support constructed in accordance with the present invention.

In FIG. 1 of those drawings, a pedestal support for an elevated paver deck assembly constructed in accordance with the teachings of the present invention is illustrated and generally designated by the number 10. It includes a cap 12, a tower 14, and a base 16. It may also include one or more paver shims such as shim 18 and one or more base shims such as shim 20.

Cap 12, which is shown in more detail in FIGS. 2, 3 and 4, is essentially circular in planform shape and is preferably of one-piece construction. It includes cylindrical portion 30, flange 32 which extends radially outward from the base of the cylindrical portion, and top portion 34 which extends inward from the top of the cylindrical portion. Pie-shaped cutouts such as cutout 36 are formed in the top member primarily for weight reduction. Also formed in the top member are four orthogonally-oriented spacers 38, 40, 42 and 44, each of which is oriented normal to top portion 34 and extends upward from it. Cylindrical portion 30 and top portion 34 cooperate to form cylindrical recess 46 in the underside of the cap. A plurality of radially-spaced, cylindrical recesses such as recess 48 are formed in underside 50 of flange 32.

Tower 14 is cylindrical in shape and is preferably formed from conventional, four-inch polyvinyl chloride (PVC) tubing which is commonly used in the plumbing industry in the United States. Such PVC is available in two different wall thicknesses, each having the same outside diameter and either type may be used to form the tower. Importantly, the inside diameter "d" of cylindrical recess 46 in cap 12 is sized to provide a press fit between the cap and the tower when the tower is inserted in recess 46.

Base 12 is illustrated in greater detail in FIGS. 5, 6 and 7. The base, which is preferably of one piece construction, includes circular bottom portion 60 which includes four spaced, pie-shaped cutouts such as cutout 62. The base also includes cylindrical portion 64 which is concentrically positioned on the bottom portion and extends upward from it. The bottom portion extends radially outward from the cylindrical portion defining flange 66, which includes a plurality of spaced circular cutouts such as cutout 68. Also formed in the bottom portion are four orthogonally-oriented drain slots such as slot 70. The purpose of the slots is to provide a drainage path for water flowing downward through the interior portion of tower 14. Cylindrical portion 64 and bottom portion 60 define cylindrical recess 72, the diameter "d" of which is sized to provide a press fit between the base and tower 14 when the tower is inserted in recess 72.

A significant advantage of the present invention is that the pedestal support can be quickly fabricated and assembled on site without the need of adhesives or other attachments. Moreover, the support is immediately usable upon assembly and does not require any waiting period for the curing of fillers or cement.

The present invention may also include paver shim 18 which is illustrated in FIGS. 8, 9 and 10. The purpose of the shim is to permit relative height adjustment of the pavers resting on a particular pedestal support to compensate for minor variations in paver thickness. When viewed from the top the shim is pie-shaped in appearance, having two straight sides 80 and 82 which intersect at a 90 degree angle and a third arcuate side 84 which extends between the two. Cutout 86 in the shim is in congruence with each of the cutouts in the cap such as cutout 36 and is bounded on the underside of the shim by rim 90. The shim may be positioned on the top portion of the cap in any one of the four quadrants defined by spacers 38, 40, 42 and 44 with the straight sides of the shim abutting any two adjoining spacers such as spacers 38 and 40 and with rim 90 projecting into the cap cutout. When so positioned, rim 90 will act to interlock the shim with the cap so as to prevent sliding of the shim on the top portion of the cap. The shim has a uniform thickness "t" and may be produced in various convenient thicknesses as desired. Preferably paver shims of at least two different thicknesses, for example 1/16th inch and 1/8th inch, should be provided, and at least three shims of each thickness should accompany each pedestal.

Figure 11:
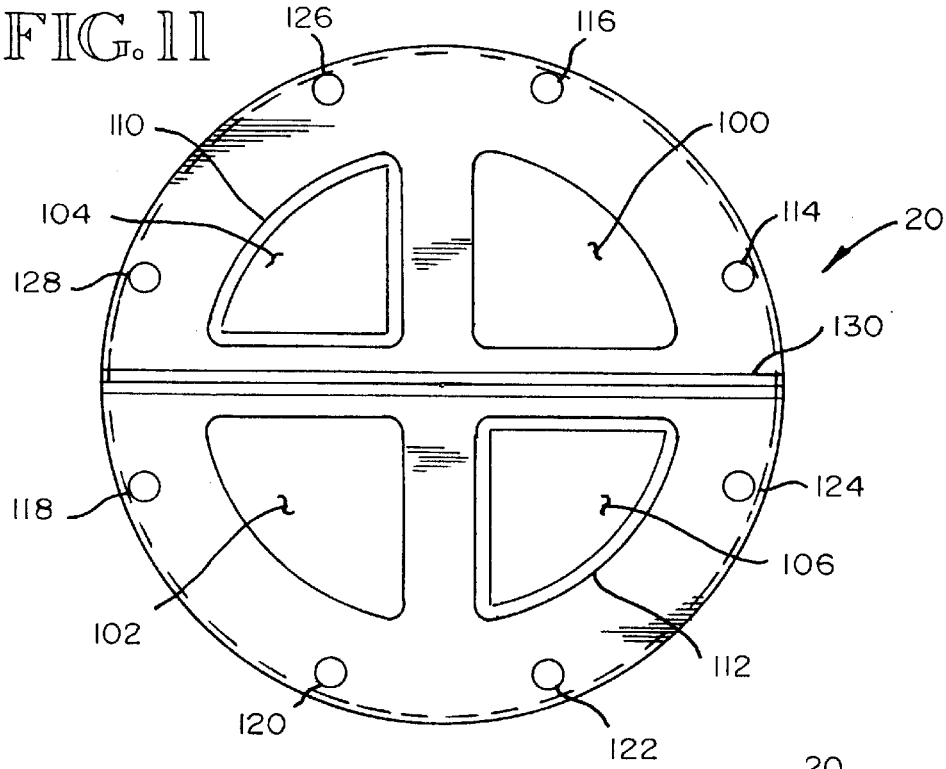
FIGS. 11, 12 and 13 are top, front and bottom views, respectively, of the base shim of FIG. 1.
Figure 12:
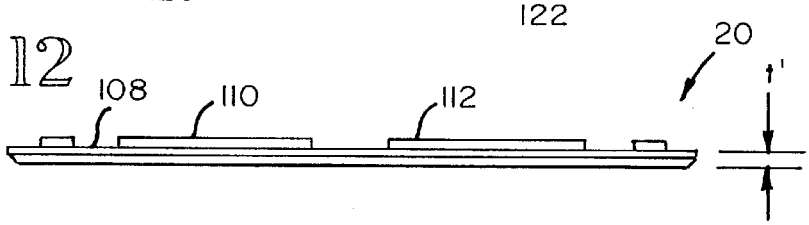
Figure 13:
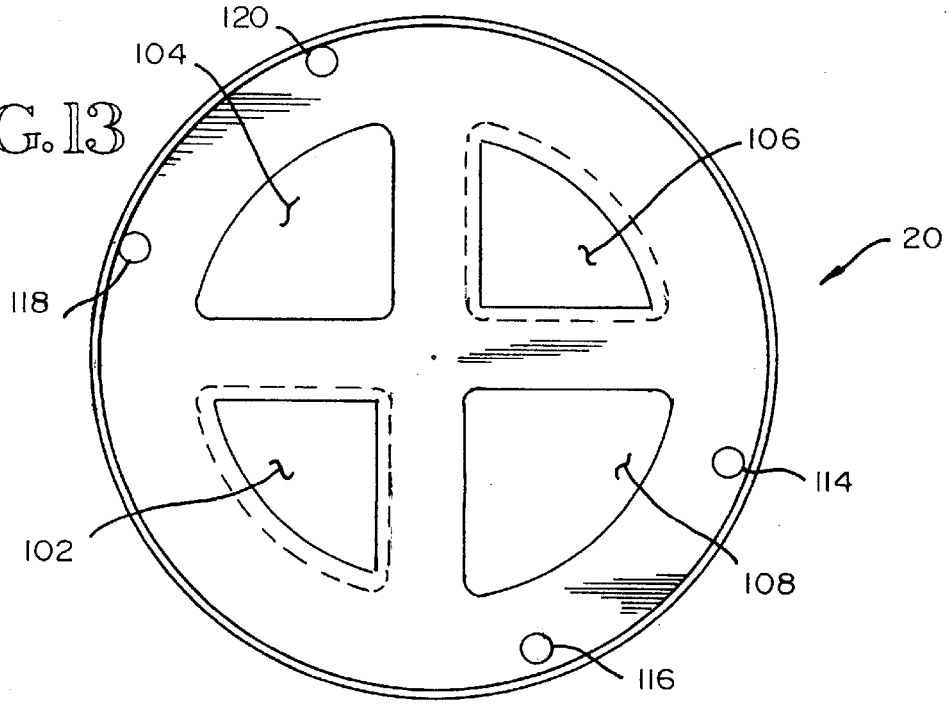

FIGS. 11, 12 and 13 illustrate a second type of shim which may be included in the present invention. The purpose of the shim is to permit minor adjustments in the overall height of the pedestal to compensate for slight miscalculations in the height needed or minor errors in the length of the tower. Base shim 20 is essentially circular in shape in planform view and includes four radially-spaced cutouts. Opposing cutouts 100 and 102 are equal in size to cutout 62 of the base whereas opposing cutouts 104 and 106 are slightly smaller. The latter two cutouts are bounded on upper side 108 of the shim by rims 110 and 112 which project upward from that surface as shown in FIG. 12. The shim also includes a plurality of circular cutouts 114, 116, 118 and 120 and a plurality of circular pins 122, 124, 126 and 128 which extend upward from surface 108. Except for the upwardly projecting pins and rims the shim is preferably of uniform thickness "t".

When the base shim is appropriately positioned beneath base 16, the pins will extend slidably into cooperating circular cutouts such as cutout 68 in bottom portion 66 of the base and the rims will extend slidably upward into cutouts such as cutout 62 in the base, thus interlocking the shim and the base so as to prevent lateral movement of the shim with respect to the base. In order to facilitate shimming it is preferable that the base shim be available in at least two different thicknesses t' such as 1/16th inch and 1/8th inch. The design of the base shim also permits the stacking of a plurality of base shims to achieve desired pedestal height, with each shim interlocking with adjacent upper and/or lower shims.

Figure 14:
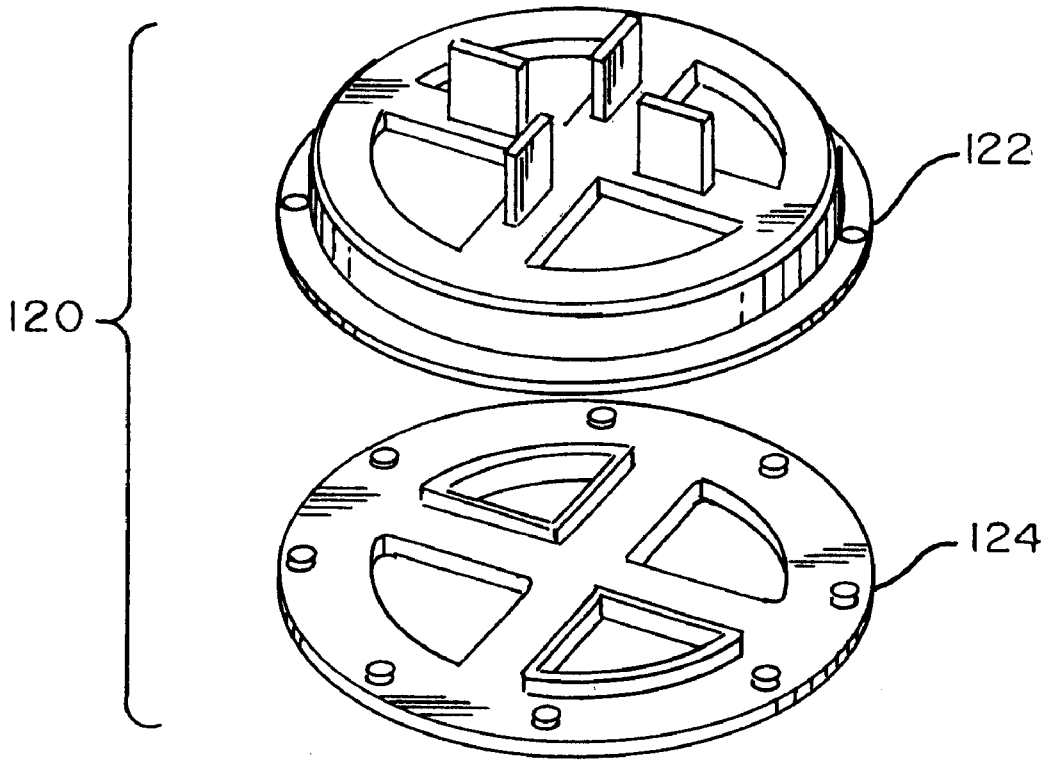
FIG. 14 is an exploded perspective view of a second embodiment of the subject invention.

Finally, the second embodiment of the present invention is shown in FIG. 14. According to that embodiment, pedestal support 120 includes cap 122 and at least one base shim 124 which are identical to cap 12 and base shim 20, respectively, as disclosed above. This embodiment may be used in circumstances where the overall pedestal height required is relatively small, as for example ½ to 1 inch. When cap 112 is appropriately positioned on top of base shim 124 the upwardly extending pins in the shim will be slidably inserted in corresponding circular cutouts such as circular cutout 48 in flange 32 of the cap, thus interlocking the two components as described above. Adjustment in the height of the pedestal support by use of base shims of various numbers and thicknesses is previously described.

In constructing a paver deck assembly according to the present invention, the first step is to establish the elevation of the reference plane in which the upper surface of the deck will lie. In almost all installations that plane will be horizontally oriented, although it is possible to construct such a deck assembly having a very slight slope. Once the reference plane has been established, a point in the plane from which all horizontal measurements will be made, called a control point, is selected. Typically, the control point will be positioned along an edge of the deck assembly near a convenient feature of an existing structure such as the threshold of a doorway.

Having established the reference plane and control point, the desired height of the pedestal support nearest the control point can then be calculated by measuring the vertical distance between the reference plane and the undersurface at the desired location of the support. This distance will be equal to the desired height of the first pedestal support. Alternately, a horizontal line can be established from the control point to the desired location and the distance can be measured from the line to the undersurface.

By knowing the dimensions of the cap and the base, including the depths of recesses 46 and 72, the contractor can then calculate the length "l" of the tower in order that the assembled support will have the desired height. Next, the tower is cut to length, most conveniently using a chop saw, and the pedestal is assembled by slidably inserting the tower into recesses 46 and 72 in the cap and base, respectively. The assembled pedestal is then placed in the desired location and the height of top portion 34 is compared with the reference plane. If the pedestal support is too high, the tower may be trimmed; if it is too low, it may be adjusted by positioning one or more base shims of appropriate thickness beneath the base.

Then, beginning at the location of the first pedestal and knowing the planform dimensions of the pavers to be used, the contractor can assemble an orthogonal array of pedestal supports, gradually positioning the pavers in place on the supports as the array grows. Each pedestal is designed to support the corners of four pavers, such as paver 130 as shown in FIG. 2, and the pavers are separated uniformly by the upwardly-projecting spacers on the cap.

In a well constructed paver deck assembly the upper surfaces of the pavers should be as level and uniform as possible. Pavers may vary slightly in thickness, so it may be necessary as the construction progresses to adjust the relative heights of the pavers resting on a particular pedestal. If irregularities are found an adjustment can be made by merely noting the apparent height difference between adjoining pavers, selecting a paver shim of the most appropriate thickness, raising the corner of the lower paver and positioning the shim in an interlocking manner over the cap cutout beneath.

It is usually desirable that the pedestal supports be oriented as close to the vertical as possible. If the undersurface on which a support rests is irregular or slightly sloped, it may be necessary to align it by placing a semi-circular portion of a base shim under the low side of the base. The shim can be easily broken along the V-shaped groove 130 in its surface by simply scoring the groove with a utility knife and then bending the shim until it breaks. The shim portions may be stacked, if necessary, to level the support.

Thus, it can be seen that the present invention provides for an improved pedestal support for use in a paver deck assembly, an improved paver deck assembly, and a novel method for constructing such a deck assembly using the pedestal support. Clearly, the present invention incorporates many novel features and offers significant advantages over the prior art. Although only two embodiments of the pedestal support have been illustrated and described, it is to be understood that obvious modifications can be made of it without departing from the true scope and spirit of the invention. Such modifications would, of course, include obvious variations in the design of the cap, base and shims which are to be considered within the scope of the claims below.

We claim:

1. A pedestal support for an elevated paver deck assembly comprising:

a tower formed of cylindrical plastic tubing and slidably mountable on a base;

a cap for supporting a plurality of pavers slidably mountable on an end of the tower, the cap including at least one cutout;

a paver shim interlockably insertable into the cutout for elevating a paver with respect to the cap; and a base slidably mountable on an opposing end of the tower.

2. The pedestal support of claim 1 wherein the tower is formed of PVC plastic tubing.

3. The pedestal support of claim 1 wherein the cap includes a cylindrical recess in which the tower may be slidably inserted.

4. The pedestal support of claim 1 wherein the base includes a cylindrical recess in which the tower may be slidably inserted.

5. The pedestal support of claim 1 wherein the cap includes a pair of orthogonally oriented spacers and wherein at least one cutout is radially disposed between the spacers.

6. The pedestal support of claim 1 wherein the base includes at least one aperture and wherein the pedestal support further includes a base shim for elevating the pedestal support with respect to an undersurface, the base shim having a protrusion interlockably insertable in and in congruence with the aperture.

7. A pedestal support for an elevated paver deck assembly comprising:

a tower formed of cylindrical plastic tubing;

a cap for supporting a plurality of pavers and including a cylindrical recess in which an end of the tower may be slidably inserted, the cap further having at least one cutout extending therethrough;

a paver shim having a protrusion interlockably insertable in and in congruence with the cutout; and, a base including a cylindrical recess in which an opposing end of the tower may be slidably inserted.

8. An elevated paver deck assembly comprising:

a plurality of pavers; and, at least one pedestal support including a tower formed of cylindrical plastic tubing, a cap for supporting a plurality of pavers and including a cylindrical recess in which an end of the tower may be slidably inserted, the cap further having at least one cutout extending therethrough, a paver shim having a rim interlockably insertable in and in congruence with the cutout, and a base including a cylindrical recess in which an opposing end of the tower may be slidably inserted.

9. The paver deck assembly of claim 8 wherein the tower is formed of PVC plastic tubing.

10. The paver deck assembly of claim 8 wherein the cap includes a cylindrical recess in which the tower may be slidably inserted.

11. The paver deck assembly of claim 8 wherein the base includes a cylindrical recess in which the tower may be slidably inserted.

12. The paver deck assembly of claim 8 wherein the cap includes a pair of orthogonally oriented spacers and wherein at least one cutout is radially disposed between the spacers.

13. The paver deck assembly of claim 8 wherein the base includes at least one aperture and wherein the pedestal support further includes a base shim for elevating the pedestal support with respect to an undersurface, the base shim having a protrusion interlockably insertable in and in congruence with the aperture.

* * * * *